United States Patent [19]

Gerhard

[11] Patent Number: 4,905,854

[45] Date of Patent: Mar. 6, 1990

[54] TANK CONTAINER

[75] Inventor: Helmut Gerhard, Weitefeld, Fed. Rep. of Germany

[73] Assignee: Westerwaelder Eisenwerk Gerhard GmbH, Fed. Rep. of Germany

[21] Appl. No.: 325,146

[22] Filed: Mar. 17, 1989

[30] Foreign Application Priority Data

Mar. 21, 1988 [DE] Fed. Rep. of Germany ..... 3809433
Jun. 3, 1988 [DE] Fed. Rep. of Germany 8807264[U]

[51] Int. Cl.[4] ..... B65D 88/06

[52] U.S. Cl. ..... 220/1.5; 220/1 B; 220/5 A; 220/18.1

[58] Field of Search ..... 220/1.5, 1 B, 18.1, 220/5 A

[56] References Cited

U.S. PATENT DOCUMENTS 4,421,243 12/1983 Taquoi ..... 220/1.5
4,640,328 2/1987 Arney ..... 220/5 A
4,648,521 3/1987 Thomas et al. ..... 220/5 A
4,813,567 3/1989 Upsher et al. ..... 220/5 A

*Primary Examiner*—Joseph Man-Fu Moy
*Attorney, Agent, or Firm*—Barnes & Thornburg

[57] ABSTRACT

A tank container suitable especially for smaller tank volumes comprises two triangular end frameworks (10) each composed of two equal-length legs (11) and a bottom transverse beam (12). The tank (15) can be joined to the framework structures (10) directly via end mounting structures (16) so that a framework base structure can be omitted. The apex of each end framework structure (10) is provided with a fitting (14) for engagement by hoisting equipment. In this way a lightweight framework is obtained. At the same time, it is possible to couple the tank container to the respective hoisting equipment at only two points without any risk of tilting during lifting.

15 Claims, 4 Drawing Sheets

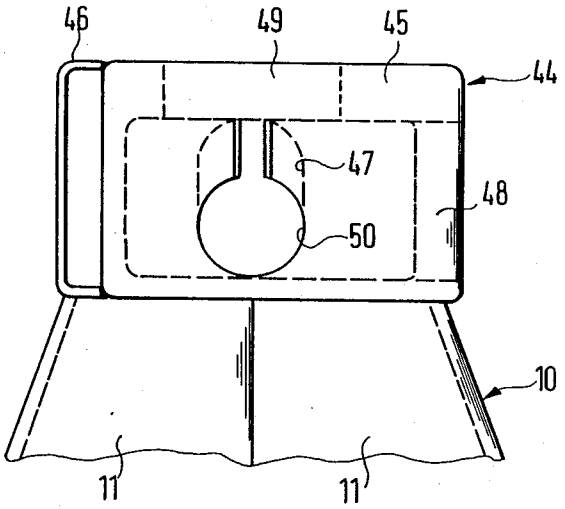
FIG. 6
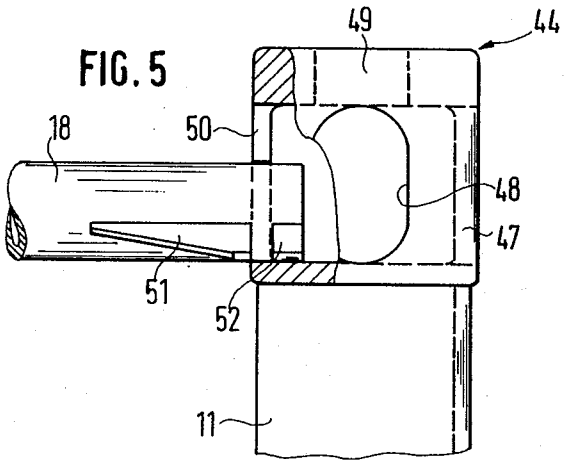
FIG. 5
FIG. 8
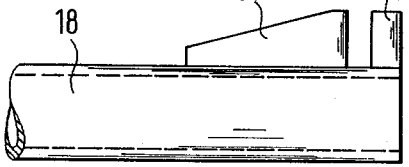
FIG. 7

TANK CONTAINER

BACKGROUND OF THE INVENTION

In conventional tank containers, the tank is disposed within a box-like framework the end parts of which are joined to each other via a base structure and upper longitudinal beams, so that the framework completely surrounds the tank.

U.S. Pat. No. 4,593,832 discloses a tank container in which the framework is reduced substantially to two rectangular end frames which are directly joined to the tank via end mounting structures, so that considerable savings in respect of material and weight are achieved.

With smaller tanks of for instance a maximum diameter of 1800 mm, as are used also as lift-on lift-off containers for dump body systems, frame structures of the specified kind are still unnecessarily heavy.

For lifting the known tank containers by means of cable lashings, grappler arms and spreaders, it is furthermore required that all four top corner fittings of the container framework or, respectively, all four grappler arm pockets provided on the framework should be engaged by the respective hoisting equipment. This entails corresponding expenditure of labour and time in the container handling.

A tank container with the features set forth in the first part of claim 1 is known from DE-A-No. 2 532 492. In one embodiment illustrated in that document, the framework consists of a bottom structure and two end frames, each end frame including two supports slanting upwardly from the transverse beam of the bottom structure to form the shape of an equilateral triangle. In the transport and storage positions, the tank is rotated about its longitudinal axis within the framework by such an angle that the tank armatures including an upper manhole and a lower discharge funnel lie within those corners of the rectangular overall framework profile that are left free by the circular profile of the tank. This permits the tank to be made as large as possible within the available profile. Accordingly, the tank reaches the highest point of the framework profile in the transport and storage positions and extends beyond the framwork profile in the filling and discharging positions.

The considerations underlying the known tank container are based on the usual box-shaped frame having a rectangular profile even though only triangular end frames are shown in one embodiment. If these are the only framework elements, the tank armatures are unprotected in all positions. Therefore, the known container is not suited in practice for handling by a number of usual hoisting equipments.

SUMMARY OF THE INVENTION

It is an object of the present invention to devise a tank container, particularly for smaller tank volumes which, while having the minimum possible weight, provides protection for the tank armatures and permits easy handling by the commonly available equipment.

To meet this object, the tank container of the present invention comprises a framework and a substantially cylindrical tank defining a tank axis, the framework including two framework structure extending transversely of the tank axis and each having the shape of an equilateral triangle with a horizontal base line and two legs which form the upwardly extending sides of the triangle and have their upper ends interconnected at an apex disposed perpendicularly above the center of gravity of the tank, the tank having upper armature means and being mounted on the two framework structures, wherein the apex of each the framework structure is positioned above the profile of the tank including the upper armature means and is provided with a top fitting for engagement by hoisting equipment.

Since the apices of the two triangular frame structures are above the tank profile including its armatures, the latter are protected against damage. Further, the fittings which are also above the tank profile permit engagement by means of only two crane hooks or coupling to only two points of a spreader commonly used in container handling. Since the two framework top corners are disposed in the vertical central longitudinal plane which includes the center of gravity of the tank, the tank container can be lifted without any risk of tilting although being engaged at only two points.

In a preferred embodiment, the legs of each the framework structure are joined to each other at a level intermediate the apex and the base line via an element adapted to be engaged by a grappler arm. This offers the possibility of lifting the tank container with only two grappler arms. Since each grappler arm pocket is limited at both ends by the two legs of the respective triangular end frame structure, any lateral sliding-off of the grappler arm is excluded. Therefore, in contrast to conventional designs, the grappler arm pocket need be only slightly wider than commonly used grappler arms. The shorter the grappler arm pocket the further above the center of gravity can it be fitted into the framework structure; accordingly, lifting of the tank container by means of grapplers becomes increasingly safe against tilting. A further advantage resides in the fact that the grappler arm pocket fitted between the two legs of the framework structure reinforces the framework structure itself.

Further protection is achieved if the top corners of the framework structures are interconnected by means of a longitudinal beam which is preferably detachable so that unhindered access to the tank connections will be possible if required. Such a longitudinal beam again improves the rigidity of the overall framework.

In another embodiment, the top fittings are each formed on a bracket which is mounted at an upper portion of the respective triangular framework structure for pivotal movement about an axis parallel to the tank axis. This structure is particularly suitable for handling the tank container by means of a top spreader. Since the container has only two top fittings, only two of the total of four twistlocks provided on such a spreader will engage the container. Although the weight and design of these spreaders are such that they will function properly even under asymmetrical load, lifting the present tank container would result in a tilting within the twistlocks, which tilting is avoided by the above measure.

As a further feature, the the bracket is mounted to the upper portion by means of a pivot pin rotatable in an opening, the engaging peripheral surfaces of the opening and pin are formed circular-cylindrical in their upper portions and have complementary V-shapes in their lower portions, the opening being elongated in the perpendicular direction. This tructure is of particular advantage in that it ensures that the top fittings automatically return to their normal position when the container is set down, so that the fittings will then be in their proper condition for being again engaged by spreader twistlocks or crane hooks. At the same time, the structure of claim 9 provides an abutment which limits the angle between the lower plane of the spreader and the plane of the tank container as determined by its weight.

In a still further embodiment, the lower ends of the two legs of each the framework structure are connected to a reinforcing ring surrounding the tank, the reinforcing ring being in turn connected via supports to corner fittings of bottom transverse beams extending transversely of the tank axis. This concept can be used with a tank of an axial length that exceeds the spacing between the top framework corners as determined by the commonly used handling gear, due to the fact that the bottom ends of the two legs of each triangular framework structure are joined to a reinforcing ring surrounding the tank, which in its bottom region is joined via supports to a bottom transverse beam of the framework. The legs and also the supports may extend tangentially towards the reinforcing ring, or they may respectively be aligned with each other; in the latter case the individual framework structure is configured as a triangle which is interrupted by the circular shape of the tank cross-section.

BRIEF DESCRIPTION OF THE DRAWINGS

FIGS. 5 and 6 show a side view and an inner end view of the top right-hand corner portion, as viewed in FIGS. 2 and 4, of the container framework in a preferred configuration, FIGS. 7 and 8 show a side view and an end view of a longitudinal beam joining the top corner portions.

DESCRIPTION OF PREFERRED EMBODIMENTS

Figure 2:
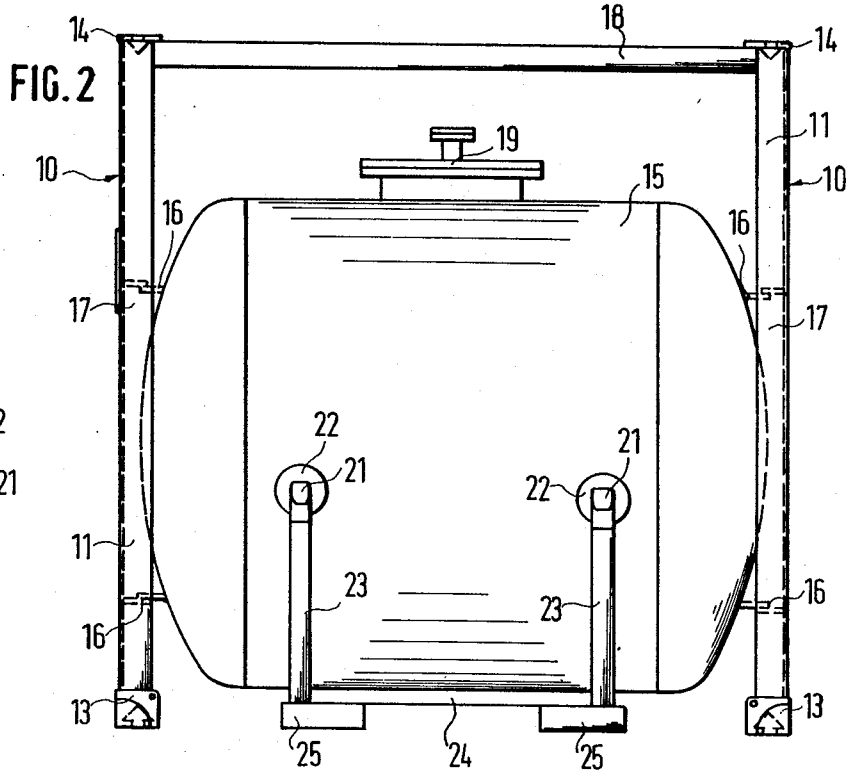
FIGS. 1 and 2 show an end view and a side view of a tank container.
Figure 1:
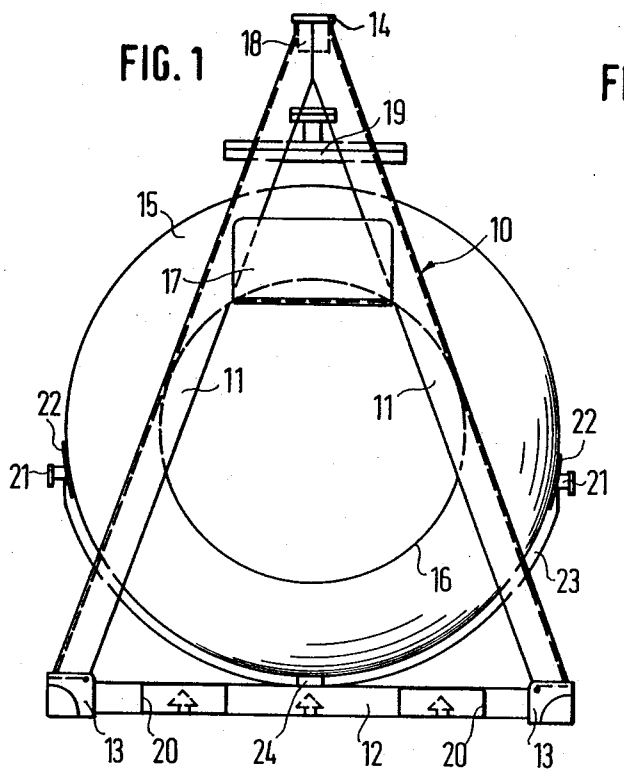

In the tank container illustrated in FIGS. 1 and 2, the framework is composed of two framework end structures 10 each being configured as an equilateral triangle and composed of two equal-length legs 11 and a bottom transverse beam 12. The bottom ends of the legs 11 are respectively joined to the extreme ends of the transverse beam 12 via a corner fitting 13. At the apex of the triangle, both legs 11 are welded to each other and are provided with a fitting 14 at their common top end. In its simplest form, the fitting 14 may be a horizontally extending plate provided with an elongated opening for engagement by a twistlock as usually provided on spreaders, the plate being welded at its three sides to the three top edges of the legs 11, which are constituted by angle sections.

The tank 15, which as shown in the end view of FIG. 1 has a circular-cylindrical cross-section, is joined to the legs 11 of the two framework structures 10 via end and mounting rings 16 extending from the tank ends. Such mounting structures composed of end and mounting rings are known from U.S. Pat. No. 4,593,832 in conjunction with rectangular end frames.

Between the bottom transverse beam 12 and the top corner fitting 14 at a level above the tank axis, the two legs 11 of each framework structure 10 are interconnected via a grappler arm pocket 17 the vertical plate of which is welded externally to the vertical flanges of the angle sections which constitute the legs 11.

As will be apparent from FIG. 2, the two end framework structures 10 are further interconnected in the vicinity of their top apices by means of a preferably tubular longitudinal beam 18. The beam 18 extends above the tank armatures indicated at 19 and is detachably joined (not illustrated in detail) to the framework structures 10 so as to allow free access to said tank armatures. A preferred design for a detachable joint will be explained further below with reference to FIGS. 5 to 8.

The bottom transverse beams 12, which may be made from L-section material or square hollow-section material, are provided with two fork-lift channels 20. Furthermore, the bottom horizontal flange of each transverse beam 12 is provided with several openings for inserting twistlocks or other locking elements so that the tank container can be secured to a loading area not only at its bottom corner fittings 13 but also at intermediate locations. In the illustration of FIG. 1, three locations are shown where such locking members may engage.

Each side of the tank 15 is provided with two cams 21 so that it can be used like a conventional lift-on lift-off tipping container in combination with dump body systems. The cams 21 are mounted on the tank shell by means of reinforcement plates 22. Reinforcing rings 23 which surround the bottom side of the tank also terminate at these plates 22. At their lowermost locations, the two reinforcing rings 23 are interconnected by means of a longitudinal beam 24 supporting the tank bottom. Two further forklift channels 25 extending perpendicularly to the tank axis are welded to the bottom side of said longitudinal beam 24 and reinforcing rings 23.

Figure 4:
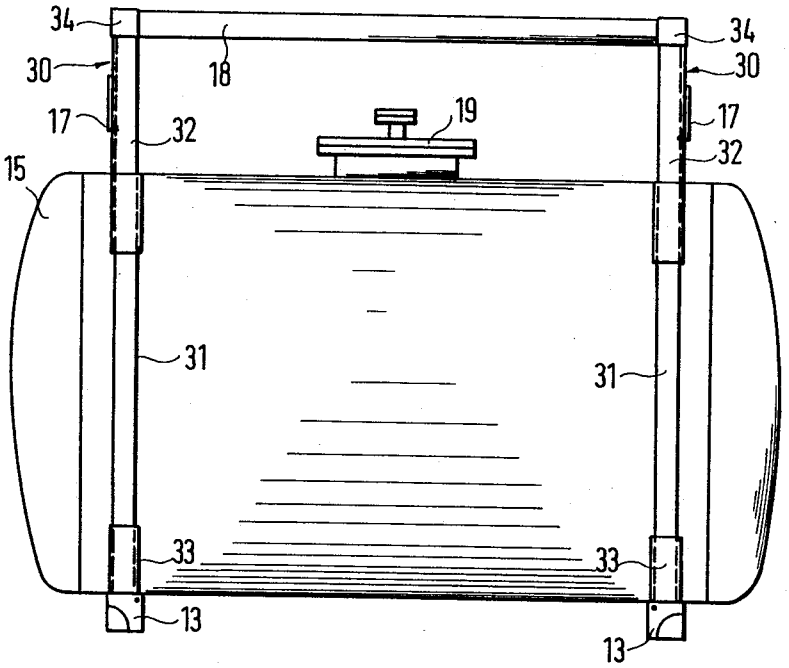
FIGS. 3 and 4 show an end view and a side view of a tank container according to a second embodiment.
Figure 3:
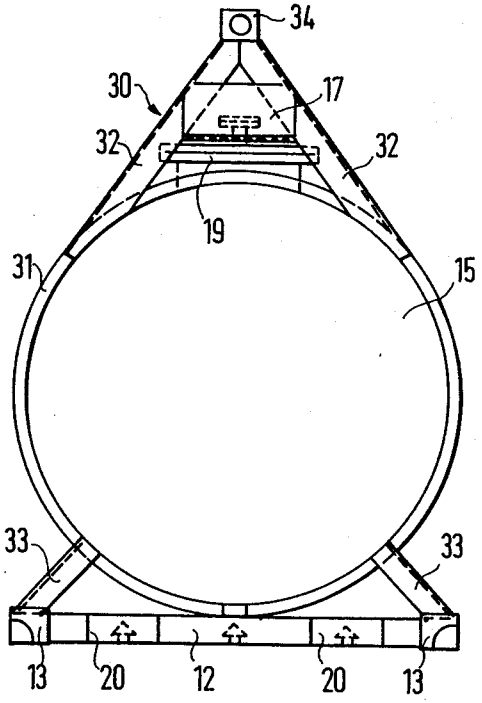

In the embodiment illustrated in FIGS. 3 and 4, the axial length of the tank 15 is greater than the length of the framework, which is based on the regular ISO spacing (2260 mm) of the twistlocks on ISO vehicles and ISO spreaders. Therefore the framework structures 30—in contrast to the framework structures 10 of FIG. 2—are no longer provided endwise and joined to the tank ends but are connected to reinforcing rings 31 surrounding the tank shell. Basically, the framework structures 30 may have the same overall triangular configuration as the framework structures 10 of FIG. 1, merely interrupted by the tank 15. In that case (which is not illustrated) the top and bottom portions of each leg would lie on a straight line connecting the tip of the framework structure with the respective bottom corner fitting.

However, FIGS. 3 and 4 illustrate a design in which the top legs 32 of each framework structure extend at a less acute angle in comparison with FIG. 1 and meet the reinforcing ring 31 approximately tangentially. The lower connection between the tank 15 and the bottom corner fittings 13 is effected by supports 33 which extend radially towards the tank and are likewise welded to the reinforcing rings. Alternatively, the supports 33 may extend vertically upwardly from the bottom corner fittings 13 and meet the reinforcing ring 31 tangentially.

As will be apparent from FIG. 3, due to the larger angle included between the top legs 32 of the framework structure, the point where the grappler arm pocket 17 is inserted is still further above the tank 15.

When lifting the tank container by means of commonly used spreaders, two twistlocks thereof with their heads indicated in FIG. 2 engage in top openings provided in the fittings 14. Since modern spreaders are provided with an automatic control which will only be operative when all four spreader twistlocks engage the usually four top corners of a container, provision must be made for correspondingly switching over said control so as to permit handling of the presently described tank containers. In any case the illustrated tank containers only require to be coupled to two points of the lifting gear, and due to the symmetric design relative to the vertical longitudinal center plane of the tank any risk of tilting is prevented. The same applies to lifting the tank container by means of two grappler arms engaging the grappler arm pockets 17.

The tank container may be lifted likewise without a risk of tilting by means of only two crane hooks. To this end it is advantageous when the top fitting 14 consists not only of a horizontal plate as illustrated in FIGS. 1 and 2 but is designed as a cuboid fitting 34 of the type illustrated in FIGS. 3 and 4, which is provided with an elongated hole not only in its upper surface but also in the surface remote from the opposite fitting.

In the preferred embodiment illustrated in detail in FIGS. 5 and 6, the fitting 44 provided at the tip of each framework structure 10 includes an ISO corner fitting 45 which in a direction transversely to the tank axis is made broader by means of a U-shaped plate 46 such that the outwardly and upwardly facing openings 47 and 49 are situated symmetrically with respect to the enlarged fitting 44. The plate 46 is welded to the surface which in the normal use of an ISO corner fitting would face the tank and which is opposite to the surface having a further opening 48.

In the surface of the fitting 44 which is opposite the opening 47 and in alignment therewith, there is provided a keyhole-shaped opening 50 which consists of a circular portion with an upwardly extending slot. As will be clearly apparent from FIG. 6, the overall height of the opening 50 and the diameter of the circular portion thereof are identical with the height and width of the elongated opening 47, respectively.

In conformity with the configuration of the fitting 44 shown in FIGS. 5 and 6, the end of the tubular longitudinal beam 18 illustrated in FIGS. 7 and 8 is designed like a key, wherein the "bit" includes two web portions 51, 52 mutually spaced by a distance which is slightly smaller than the wall thickness of the fitting 44 in the vicinity of the opening 50. The profile of this key-shaped end of the longitudinal beam 18 is dimensioned so that it can be inserted into the opening 50 of FIG. 6. The two framework structures 10 and the two ends of the longitudinal beam 18 are designed to be symmetrical with respect to the central transverse plane of the tank container.

For assembly, one end of the longitudinal beam 18 is initially inserted into the opening 50 of a fitting 44 and is pushed through the outer opening 47 thereof until the other end is within the opposite framework structure 10 and can now be inserted into the fitting provided thereat by movement of the longitudinal beam 18 in the opposite direction. As soon as the web portion 51 at either end of the longitudinal beam 18 is outside of the respective fitting 44 and the web portion 52 is inside the same, the beam 18 will be locked by rotation to the position illustrated in FIG. 5. Due to the weight of the web portions 51, 52 this anchoring cannot undo itself; additional locking means may be provided. Even with the beam 18 anchored, the openings 47 to 49 of both fittings 44 remain freely accessible for engagement of spreaders, crane hooks or other commonly used handling gear.

Figure 9:
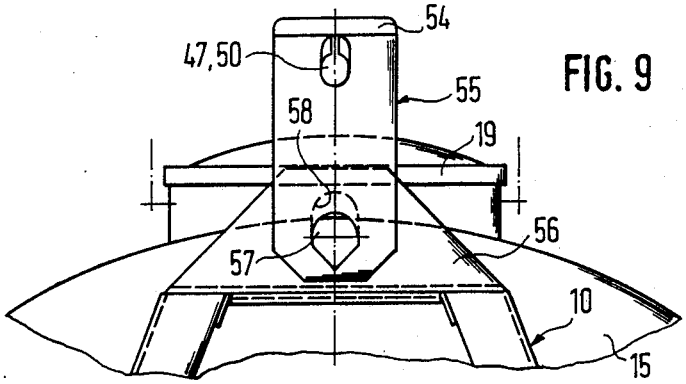
FIGS. 9 to 11 are partial views of an upper frame area according to another modification shown in three diefferent operating positions.
Figure 10:
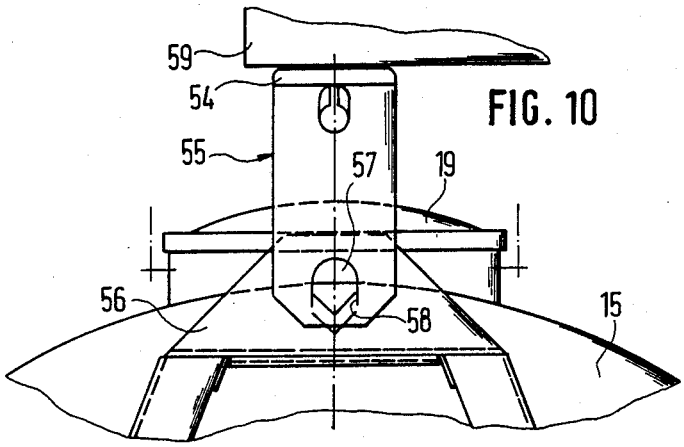
Figure 11:
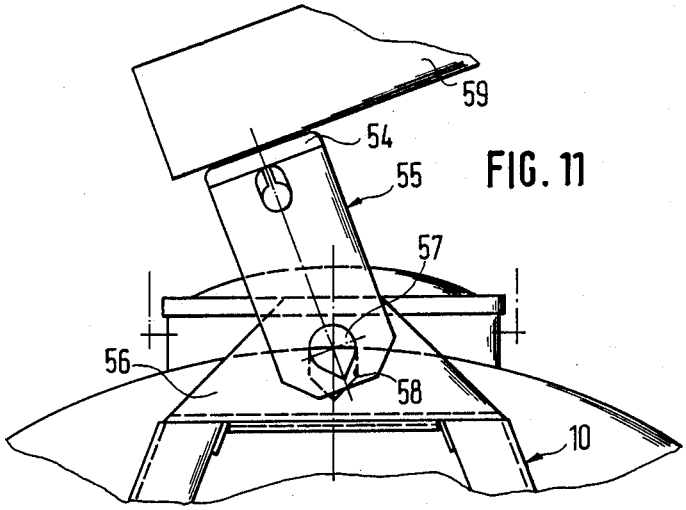

In the embodiment of FIGS. 9 to 11, the design of the upper area of each triangular framework structure 10 differs from that of the preceeding embodiments in that the fitting 54 forms the upper wall member of a U-shaped bracket 55 of which only an outer wall is shown in FIGS. 9 to 11. The bracket 55 straddles a structural member 56 which forms the upper portion of the framework structure 10. A pivot pin 57 extending parallel to the tank axis is provided in the bracket 55 and penetrates an opening 58 provided in the member 56. In their upper portions, the two side wall members of the bracket 55 are provided with openings 47, 59 which are formed like the corresponding openings in the corner fitting 54 of FIGS. 5 and 6 and serve for detachably locking the longitudinal beam 18 (not shown).

The pin 57 has a peripheral surface which in its upper portion extending through e.g. 270° is formed circular-cylindrical and in its lower portion forms a rectangular V-shape. The opening 58 is formed as an elongated hole with its longest axis extending perpendicularly. In its upper portion, the opening 58 has a cylindrical surface extending through 180°, while its lower portion is provided with a V-groove shaped complementarily to the V-portion of the pivot pin 57.

In the partial representation of FIG. 9, the tank container is shown in a set-down condition in which the bracket 55, due to its own weight, is in its lowermost position, and the pivot pin 57 rests in the lowermost portion of the opening 58. The lower V-shapes of the pin 57 and opening 58 cause the bracket 55 to assume an upright position in which the upper wall member of the fitting 54 extends horizontally.

In this attitude, the fitting 54, which in its upper wall member has an opening similar to the opening 49 in the corner fitting 45 of FIGS. 5 and 6, may be lifted for instance by means of the twistlock of a spreader schematically shown at 59 in FIGS. 10 and 11. FIG. 10 shows the condition in which the spreader 59 has lifted only the bracket 55, whereas the tank container itself is still supported from below. In this condition, the pin 57 has moved towards the upper surface of the-opening 58. The two cylindrical surfaces of the pin 57 and opening 58 now cooperate to form a pivot having an axis parallel to the tank axis.

In FIG. 11, the spreader 59 has lifted the tank container and now tilts due to the fact that the weight of the tank container suspends from only two of the total of four twistlocks, thus asymmetrically with respect to the axis of gravity of the spreader. (The tilting angle has been exaggerated in FIG. 11 for the sake of clarity.) As shown in FIG. 11, the pin 57 provided in the bracket 55 has rotated with respect to the opening 58. The maximum angle of rotation is limited by a side surface of the V-shaped lower portion of the pin 57 abutting against the corresponding vertical side surface of the opening 58.

While FIGS. 9 to 11 assume that the pin 57 is connected in the bracket 55 and the opening 58 is provided in the upper member 56 of the framework structure 10, it is alternatively possible to provide the member 56 with studs extending inwardly and outwardly and extending through corresponding openings provided in the bracket 55.

What is claimed is:

1. A tank container comprising a framework and a substantially cylindrical tank defining a tank axis, said framework including two framework structures extending transversely of said tank axis and each having the shape of an equilateral triangle with a horizontal base line and two legs which form the upwardly extending sides of the triangle and have their upper ends interconnected at an apex disposed perpendicularly above said tank, axis said tank having upper armature means and being mounted on said two framework structures, characterized in that the apex of each said framework structure is positioned above the profile of said tank including said upper armature means and is provided with a top fitting for engagement by hoisting equipment.

2. The tank container of claim 1, wherein said legs of each said framework structure are joined to each other at a level intermediate said apex and said base line via an element adapted to be engaged by a grappler arm.

3. The tank container of claim 1, wherein said two framework structures are joined to each other at their apices via a longitudinal beam.

4. The tank container of claim 3, wherein said longitudinal beam is detachably connected to said framework structures.

5. The tank container of claim 4, wherein said longitudinal beam has key-shaped configurations at both ends thereof for engagement in keyhole-shaped openings formed in the mutually facing surfaces of said top fittings.

6. The tank container of claim 5, wherein each keyhole-shaped opening has a slot extending upwardly from a circular portion, each end of the longitudinal beam including first and second web portions which, when said beam end engages said opening are disposed outside and inside of said opening, respectively.

7. The tank container of claim 5, wherein said fitting is formed of an ISO corner fitting having an opening in its top surface and being widened by a structural part attached to it in a direction transverse to the tank axis such that said upper opening is disposed symmetrically with respect to the overall width of said fitting.

8. The tank container of claim 1, wherein the top fittings are each formed on a bracket which is mounted at an upper portion of the respective triangular framework structure for pivotal movement about an axis parallel to said tank axis.

9. The tank container of claim 8, wherein said bracket is mounted to said upper portion by means of a pivot pin rotatable in an opening, the engaging peripheral surfaces of the opening and pin are formed circular-cylindrical in their upper portions and have complementary V-shapes in their lower portions, said opening being elongated in the perpendicular direction.

10. The tank container of claim 1, wherein the lower ends of said legs of each said framework structure are joined to the ends of a bottom transverse beam via respective corner fittings.

11. The tank container of claim 1, wherein the lower ends of the two legs of each said framework structure are connected to a reinforcing ring surrounding said tank, said reinforcing ring being in turn connected via supports to corner fittings of bottom transverse beams extending transversely of said tank axis.

12. The tank container of claim 10, wherein said bottom transverse beams are provided with fork-lift pockets.

13. The tank container of claim 10, wherein said bottom transverse beams are provided with openings for engagement by locking elements.

14. The tank container of claim 1, including fork-lift channels extending transversely of said tank axis below said tank and being supported by reinforcing rings which at least partially surround said tank.

15. The tank container of claim 1, wherein said tank is provided with laterally projecting cams for accommodation in dump body systems.

* * * * *